United States Patent [19]

Raber

[11] 4,000,705

[45] Jan. 4, 1977

[54] PROCESS FOR DISPOSING OF ANIMAL CARCASSES

[75] Inventor: J. Wayne Raber, Huntington, Ind.

[73] Assignee: Phillip Kaehr, Decatur, Ind. ; a part interest

[22] Filed: Oct. 20, 1975

[21] Appl. No.: 623,949

Related U.S. Application Data

[63] Continuation of Ser. No. 494,079, Aug. 2, 1974, abandoned.

[52] U.S. Cl. ..... 110/3; 110/11; 202/133; 110/8 C

[51] Int. Cl.[2] ..... F23G 1/00

[58] Field of Search ..... 110/3, 8 R, 8 C, 8 A, 110/11; 202/133; 431/183

[56] References Cited

UNITED STATES PATENTS

| | | | |
|---|---|---|---|
| 1,677,784 | 7/1928 | Kemp | 202/133 |
| 2,925,054 | 2/1960 | Sherman | 110/8 |
| 3,001,487 | 9/1961 | Meyer | 110/8 |
| 3,176,634 | 4/1965 | Martin | 110/3 |
| 3,177,827 | 4/1965 | Melvin | 110/3 |
| 3,362,887 | 1/1968 | Rodgers | 110/11 |
| 3,643,610 | 2/1972 | Bycroft | 110/8 |
| 3,651,771 | 3/1972 | Eberle | 110/8 |
| 3,680,500 | 8/1972 | Pryor | 110/8 |
| 3,694,135 | 9/1972 | Dancy et al. | 431/183 |
| 3,771,468 | 11/1973 | Kelly | 110/11 |

*Primary Examiner*—Kenneth W. Sprague

[57] ABSTRACT

The carcass of a dead animal is placed within a heating chamber and a burner disposed at one end of the chamber emits a flame which substantially engulfs the chamber. A control for fuel/air mixture of the burner insures a steady reliable heating action which elevates the chamber to approximately 1200° F at which time the animal carcass, without substantial incineration, is pyrolytically decomposed so that the animal material is destructively distilled out of the chamber and up the stack, the stack being located at the end of the heating chamber remote from the burner. The volatilized hydrocarbon may either be condensed, vented to atmosphere or burned within the stack through an afterburner. The volatilized hydrocarbon is biodegradable and does not have an adverse polluting effect upon the environment.

The foregoing process occurs without substantial emission of visible smoke or offensive odors.

12 Claims, 7 Drawing Figures

PROCESS FOR DISPOSING OF ANIMAL CARCASSES

This is a continuation-in-whole of Patent Application Ser. No. 494,079, now abandoned, filed Aug. 2, 1974 and entitled "PROCESS FOR DISPOSING OF ANIMAL CARCASSES."

BACKGROUND OF THE INVENTION

The disposal of such dead animal carcasses as pig fetuses, chickens, sheep and the like in agricultural husbandry and the disposal of dogs, cats and domestic pets proves to be a substantial challenge since burning such material is objectionable even under the most ideal conditions, because of the offensive smoke and odors generated as a byproduct of incineration. The common practice in eliminating such products is to fire up an incinerator as hot as possible and perform the burning operation at remote locations from habitations and other businesses. Even so, the acrid smoke and fumes are persistent and tend to carry over long distances to become a nuisance. The burning of dead animal tissue is one of the most difficult operations to carry out in an acceptable manner by the conventionally practiced incineration procedures.

In fact, the very shortcoming of the prior art is that these operations do take place by way of incineration.

SUMMARY OF THE PRESENT INVENTION

It has been found, that by eliminating incineration of dead animal tissue and following instead an entirely different procedure, namely pyrolytic decomposition to effect destructive distillation by volatilization and dehydration of such tissue and subsequent removal of such gaseous conversion products, that animal tissue can be reduced to a clean ash without smoke or smell. The distillation product can either be vented directly into atmosphere or subsequently burned. This procedure proves to be successful solution of how to rid a farm or clinic of dead animals such as pig fetuses, lamb fetuses or other dead animals which invariably collect as a byproduct of animal husbandry and veterinarian practice.

It is an object of the present invention to employ an entirely different technique for disposal of such animal tissue, not by incineration, but rather by pyrolytic decomposition which destructively distills out of the animal tissue the moisture, fatty acids, and other volatilizable organic products by subjecting such animal carcasses to sufficient heat to bring about this decomposition without the accompaniment of incineration and consequently odors, smoke, smoldering and charring which was previously so objectionable.

Another object of the present invention is to reduce animal tissue to a clean irreducible ash and to do so by a distillation process which avoids the generation of visible smoke and odor, all of which can occur in a relatively short time and with inexpensive equipment which is quite easy to maintain and follow.

Another object of the present invention is to provide a distillation apparatus in which animal products (animal carcasses and the like) are quickly and easily disposed of at locations which would be prohibitive to conventional incineration processes thereby making it more convenient and more sanitary to dispose of dead domesticated animals immediately and hygenically before becoming a source of infection. Animals which can be disposed of are dogs, cats and the like and the operation is frequently necessary to perform in veterinarian clinics, dog pounds and the like within city locations.

Other objects and features of the present invention will become apparent from a consideration of the following description which proceeds with reference to the accompanying drawings.

DRAWINGS

SPECIFIC WORKING EXAMPLE OF THE INVENTION

Figure 1:
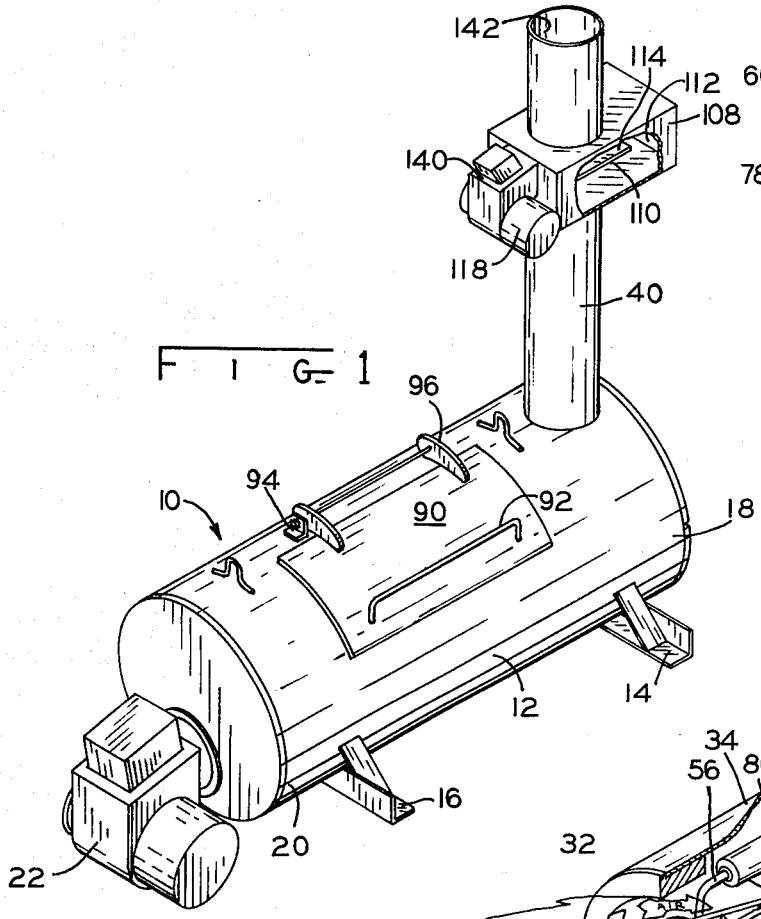
FIG. 1 is an isometric view of the distillation apparatus and stack which may include an after-burner as indicated broken away in the stack portion of FIG. 1.

The distillation apparatus designated generally by reference numeral 10 consists of a cylindrical housing 12 supported on pedestals 14, 16 one at each of ends 18 and 20 and includes a burner 22 at one end thereof. Details of the apparatus 10 are disclosed in U.S. Pat. No. 3,808,985 titled "INCINERATOR", issued May 7, 1974.

The burner, designated generally by reference numeral 22 is obtained from Wayne Home Equipment Company, Inc., 801 Glasgow Ave., Fort Wayne, Ind. and one satisfactory model is the oil burner model EHA.

Figure 4:
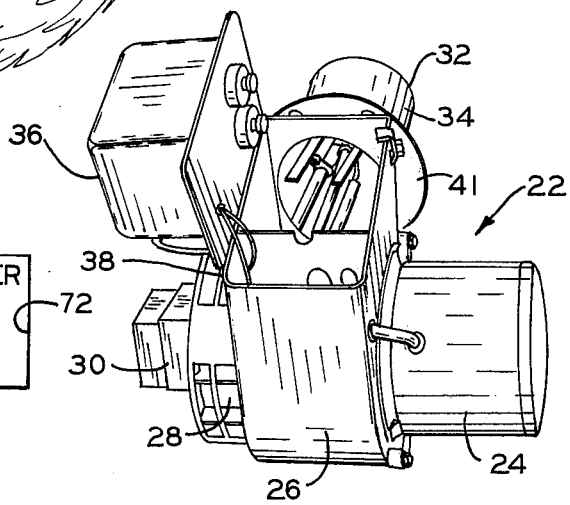
FIG. 4 is an isometric view of the burner assembly.

Burner 22 is operated by an electric motor 24 which turns a blower within blower housing 26 and an air damper 28 at one end of housing 26 controls the inflow of air developed by the rotary blades. Fuel is injected through a fuel pump 30 and is vaporized and mixed with air and blown under pressure through an air cone 32 and air tube 34. Above the assembly is an ignition transformer 36 which is hinged at one side 38 to the assembly and is shown raised from its operative position in FIG. 1 to the position in FIG. 4. The burner 22 is referred to as a sleeve burner and is highly efficient since it does not rely upon the draft developed by chimney 40 but instead produces the appropriate fuel-air ratio by means of the air damper and inlet for air which produces the appropriate air/fuel ratio within the air cone 32 and air tube 34, utilizing the smallest quantity of air for an efficient functioning of the oil burner which proportions and mixes the atomized oil and air required for combustion. The fuel-air mixing occurs in the manner shown in FIG. 2 wherein the flange 41 is used for mounting the air cone 32 and air tube 34 onto the burner assembly 22.

The incoming air designated generally by reference numeral 44, passes over air diffusers 46 and circulates toward the end 48 of the air tube 34 until it reaches nozzle 50 which is made up of an inner body called a distributor (not shown) and an outer body including an orifice 52.

The oil sprays through the orifice under a pressure of approximately up to 300 PSI and then swirls through the distributor and is discharged from the orifice 52 as a spray. The spray is ignited by a spark 54 derived from electrodes 56 and 58 which cause the atomized oil to be ignited and burned with the aid of the combustion supporting airflow. The electrodes are powered by the transformer which raises the voltage from 115 to 10,000 volts and it should be noted that the electric spark 54 is located in proximity to the nozzle spray from the nozzle 50.

Figure 5:
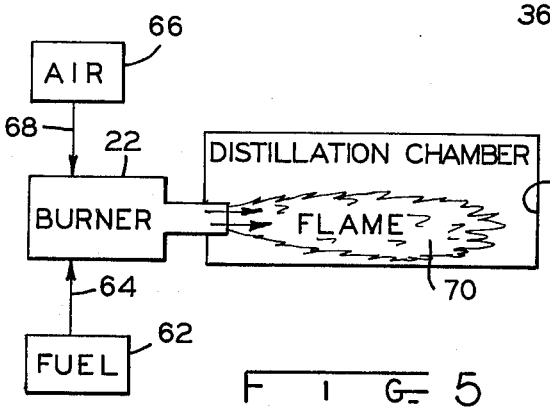
FIG. 5 is a block diagram of the fuel burning operation process.

As the flow is developed, it is shaped into a preferred form by means of a flame retention head 60 which is the subject of U.S. Pat. No. 2,761,735. Schematically, as indicated in FIG. 5, the fuel designated generally by reference numeral 62 is fed through a supply line 64 to the burner 22 where it is met by a supply of air indicated by reference numeral 66 through line 68 and the combination then generates a flame 70 within distillation chamber 72.

Figure 3:
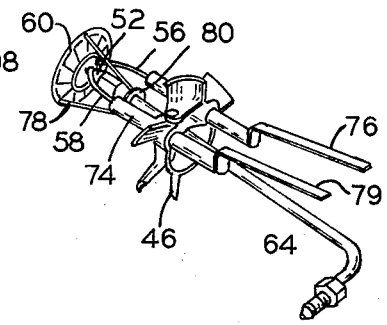
FIG. 3 is an isometric detail view of the fuel feeding apparatus and means for channeling the incoming air.

Referring to FIG. 3, electrodes 56 are held by a support 72 and are insulated by porcelain as indicated by reference numeral 74 before being brought into near intersection for generating the spark that produces combustion of the oil. Comparing FIGS. 2 and 3, the insulator 74 may be porcelain and the electrodes are joined by brass electrode springs 76 and 79 which automatically make and break in accordance with burning conditions.

Figure 2:
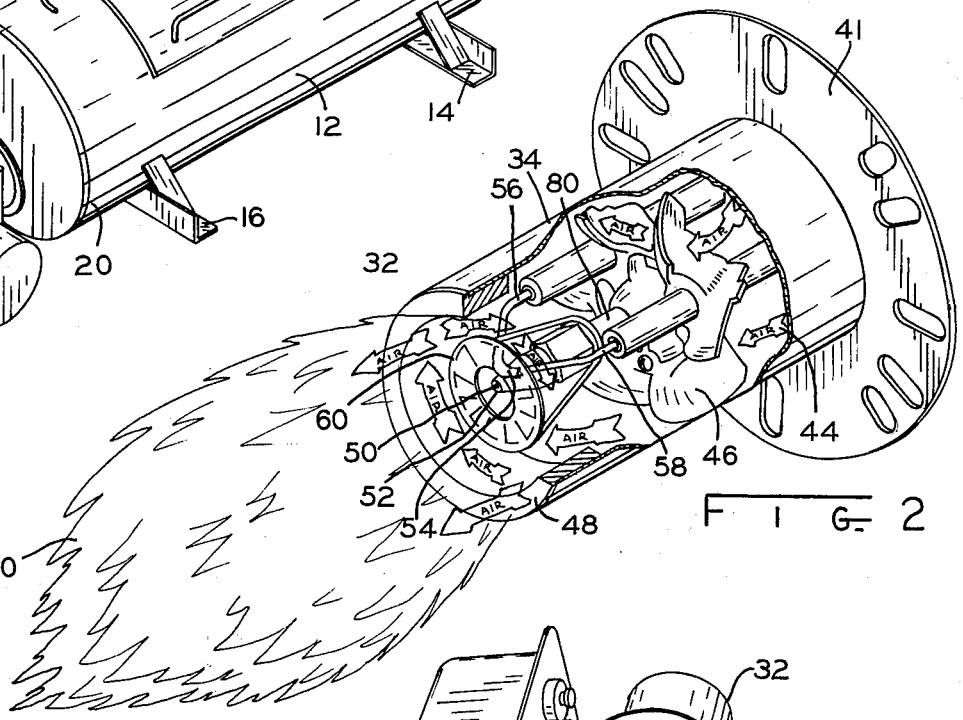
FIG. 2 is an isometric exploded view of the burner which is used at one end of the distillation apparatus.

The flame retention head 60 shown from the rear side of FIG. 3 shapes the flame into a preferred swirling conical shape whereby the heat is more evenly distributed and retained within the distillation chamber 72. The flame retention head 60 is supported by a mounting member 78 as indicated in FIGS. 2 and 3 on bracket 80.

The advantages of the burner described is that it produces a stable high temperature flame with a high air velocity insuring a good air-fuel mixture and the overall combustion efficiency is such that there will be a savings in fuel.

Figure 6:
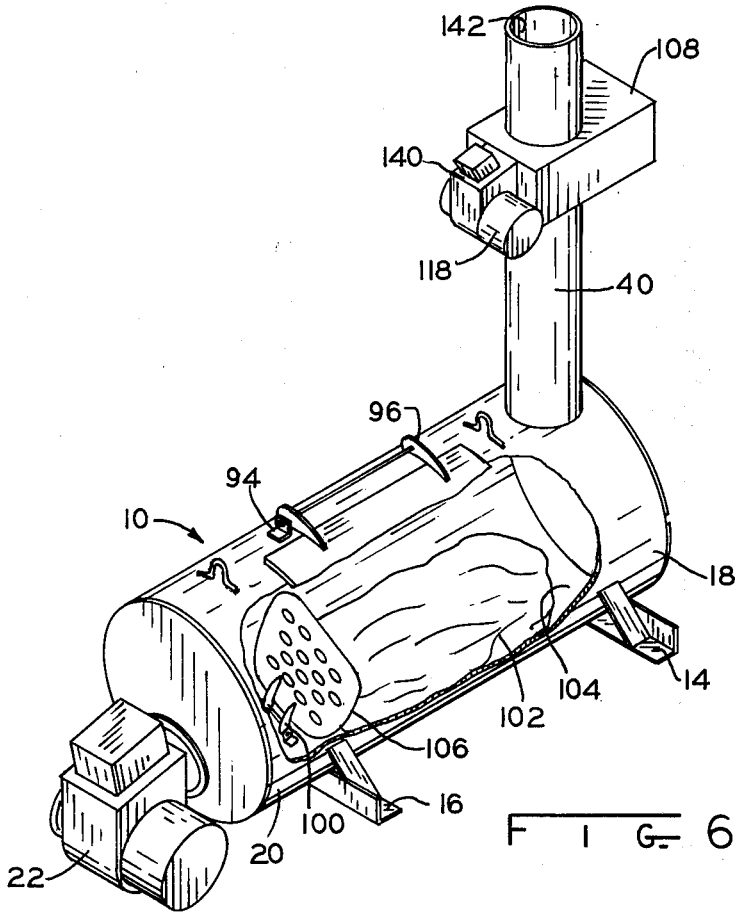
FIG. 6 is an isometric view of the distillation apparatus with a portion thereof broken away to show a deflector plate at the interior of the chamber to prevent direct exposure of the carcass to flame.

Referring next to FIGS. 1 and 6, a charging door 90 having a handle 92 and hinges 94, 96 is lifted to provide access to the interior of the distillation apparatus. To prevent direct contact of the flame 70 with the animal tissue intended to be consumed, there is a perforated shield 98 which is hinged at 100 and lifted to permit the animal carcass 102 to be placed under the shield. The animal carcass is placed at the bottom 104 of the distillation chamber and shield 98 is then pivoted downwardly to be interposed between the flame and the carcass.

The perforations 106 while preventing direct access or contact between the flame and the carcass permit the distillation product from the destructive distillation of the carcass to travel upwardly and out of the stack 40. At the stack 40 is an after-burner 108 and a baffle 110 therein which directs the flow first to section 112 and then back to section 114 where a burner 118 directs a flame together with sufficient additional air to completely burn all of the destructive distillation products which are generated within the chamber 72. Alternatively, the distillation byproducts consisting of essentially fatty acids, glycerin, amino acids and the like can be vented by stack 40 directly to atmosphere. In a still further embodiment such distillation products can be passed to a condenser 130 (FIG. 7) where such products are condensed and removed before the stack gasses are vented to atmosphere.

Figure 7:
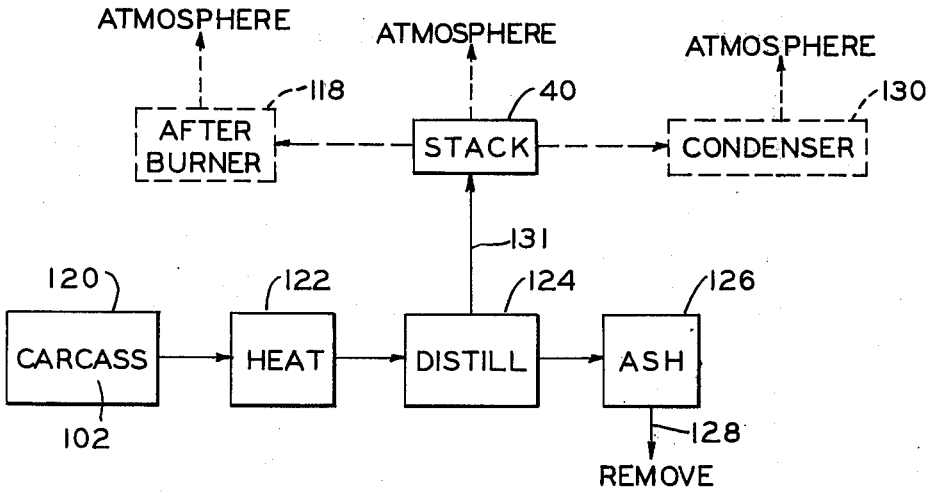
FIG. 7 is a block diagram of the material being destructively distilled.

Referring to FIG. 7, the block diagram indicates the carcass in block 120 as being heated in block 122 and the organic material, rather than carbonizing or charring, is subjected to sufficient heat, i.e., heat in the order of 2,000° F (and stack temperature in the order of 1,100° to 1,400° F) so that the organic material will be destructively distilled from the carcass as indicated by block 124 and the residue reduced to ash 126 which is periodically removed as indicated by line 128. The destructive distillation product in the form of protein, fatty acids, glycerin, water, etc. is passed upwardly as indicated by line 131 through the stack 40 where it is either subjected to an after-burner and the product totally consumed with sufficient oxygen to oxidize the distilled product or the distilled product is condensed in the manner indicated by block 130.

OPERATION OF THE INVENTION

In operation, shield 98 and charging door 90 are lifted and carcass 102 placed in the base 104; shield 98 and charging door 90 are then lowered and the burner 22 is actuated, generating flame 70.

After the initial air is consumed within the distillation chamber 72 continued application of heat from burner 22 will cause a destructive distillation of the animal and the pyrolytically destructive product flows upwardly through stack 40 and enters after-burner chamber 112 where, by a combination of operation of after-burner 118 and air inlet 140, the distillation byproduct is reduced to a completely oxidized state and is then vented to atmosphere through outlet 142. The operation continues until the carcass is completely reduced to ash as indicated by block 126 (FIG. 7) and by the continued exposure of the carcass to the operating temperatures of the combustion chamber (which as before stated are in the order of 2,000° F), the destructive distillation process continuing until the animal carcass is completely converted to ash and organic gasses, moisture and some carbon dioxide. One of the characteristics of the operation is that the gasses which emit from the stack 142 are substantially colorless and odorless, this being in contradistinction to the stack gasses which are generated from burning animal carcasses by conventional methods.

Also an important characteristic of the present invention is the so-called dwell time for the gases within the distillation chamber 72. The dwell time varies from 0.4 to 1.8 seconds within the chamber 72 and about 0.1 seconds within the stack 40. This insures a complete distillation of all of the animal byproduct and reduction of the carcass to volatilized pyrolytically decomposed product consisting essentially of glycerin, water, fatty acids, unsaturated and saturated hydrocarbon gases. These materials can either be vented directly to atmosphere since they are biodegradable and do not contribute either noxious or harmful chemicals to the atmosphere or, in the event that emissions for a particular area are prohibited then such materials can be easily burned through an after-burner contained either in the stack or in a second chamber. In another embodiment of the invention such materials can be condensed and separately disposed of in a liquid or solid form.

It was totally unexpected that animal carcasses which heretofore presented such a substantial problem of disposal by heat could be pyrolytically decomposed through the destructive distillation process described and while, based on the best experimental and analytical evaluations, this is believed to be the mechanism by which the carcasses are decomposed, it should be understood that the theory of the operation, while plausible, is not essential to the invention but merely contributes to an understanding of the invention. Understanding the invention is particularly difficult, since all those skilled in the art apparently do not appreciate the full basis upon which the invention works, having predicted that the present invention would be no different than prior art "incinerators" and generating the usual acrid and objectionable smoke and fumes as a necessary concomitant to disposing of animal carcasses by heating thereof. Based upon experimental evidence, however, the present invention is unexpected in its results and is believed to differ fundamentally from prior methods of incineration by proceeding along a scheme of pyrolytic decomposition or destructive distillation of the carcass as distinguished from incineration or direct oxidation of the carcass.

Although the present invention has been illustrated and described in accordance with a single example embodiment, it is understood that this is illustrative of the invention and is by no means restrictive thereof. It is reasonably to be expected that those skilled in this art can make numerous revisions and adaptations and it is intended that such revisions and adaptations will be included within the scope of the following claims as equivalents of the invention.

What I claim is:

1. A process for burning dead animals comprising the steps of: disposing the animal at the base of a cylindrical chamber with a curvilinear support surface of said chamber providing a resting surface for said animal, heating the chamber and therefore the animal from the burner flame located at one end of said cylindrical chamber by a spirally directed flame which substantially engulfs the entirety of the chamber, circulating the heated air throughout the cylindrical chamber and the combustion products generated within said chamber for a period of up to 0.8 seconds to effect pyrolytic decomposition of the organic product and reduce the balance of the animal product to irreducible ash, and venting the gaseous combustion product from within said chamber through a ventilator stack disposed at the extreme end of said incinerator remotely from said burner.

2. The process in accordance with claim 1 including the step of metering outside air to the interior of said combustion chamber in a sufficient amount to effect substantially complete oxidation of the fuel but insufficient to incinerate the organic material in said animal which is distilled from said animal in the form of volatilized fatty acids, glycerine, moisture and the like.

3. The process in accordance with claim 1 including the step of periodically removing the ash content within said chamber in preparation for additional animals to be disintegrated.

4. The process in accordance with claim 1 including the step of passing the burner flame through a baffle to develop elongated swirling flame which extends from the one end of the incinerator.

5. The process in accordance with claim 1 including the step of immediately igniting the animal to develop sufficient additional heat which will support a distillation-destruction of the organic material comprising the animal carcass.

6. The process in accordance with claim 1 including the step of adjusting air inlet flow to the interior of said chamber to preclude oxidation of the animal carcass.

7. The process in accordance with claim 1 including the step of burning additional fuel within the stack to insure complete combustion of the gases distilled from said carcass prior to exiting from the outlet orifice of said stack.

8. A method for disposing of dead animals comprising the steps of: confining the animal product to be consumed within a closed chamber, heating the chamber by injection of flame which develops from a controlled air-to-fuel mixture sufficient to support substantially complete combustion of the fuel and to effect an elevation of temperature within the chamber to destructive distillation temperature values, distilling volatilizable ingredients of the dead animal tissue without accompaniment of incineration and generation of any substantial amount of odor and smoke, said animal tissue being pyrolytically decomposed under starved air conditions within said chamber, and distilling the volatilized pyrolytically generated materials derived from the animal tissue; and, continuing the process until the animal product is substantially converted to irreducible ash.

9. The method in accordance with claim 8 including the step of condensing the volatilized product derived from the pyrolytic distillation of the animal product.

10. The method in accordance with claim 8 including the step of burning by means of an after-burner disposed within the stack the distilled organic product derived from the pyrolytic decomposition of animal tissue within said chamber.

11. The method in accordance with claim 8 wherein the distillation occurs at a temperature of not substantially greater than 1400° F within said chamber.

12. The method in accordance with claim 8 which such process occurs and is characterized by substantially colorless and odorless stack emission gas.

* * * * *